US005818732A

United States Patent [19]

Vanderwilt

[11] Patent Number: 5,818,732

[45] Date of Patent: Oct. 6, 1998

[54] BATCH TIMER INITIALIZATION FOR A SAND CLASSIFYING TANK

[75] Inventor: Louis A. Vanderwilt, Des Moines, Iowa

[73] Assignee: Eagle Iron Works, Des Moines, Iowa

[21] Appl. No.: 880,702

[22] Filed: May 8, 1992

[51] Int. Cl.[6] ..... G06G 7/58

[52] U.S. Cl. ..... 364/502; 364/500; 222/64; 222/144.5

[58] Field of Search ..... 364/502, 468, 364/469, 478, 479, 571, 500, 496; 222/76, 77, 64, 132, 70, 23, 30, 144.5, 639; 110/236, 245, 246; 209/297, 234, 235; 210/532.1, 532.2, 533

[56] References Cited

U.S. PATENT DOCUMENTS

| | | | |
|---|---|---|---|
| 3,186,596 | 6/1965 | Badgett | 364/502 |
| 3,229,077 | 1/1966 | Gross | 364/502 |
| 3,913,788 | 10/1975 | McClauley | 222/64 |
| 3,959,636 | 5/1976 | Johnson et al. | 364/502 |
| 4,199,080 | 4/1980 | Keeney | 222/23 |
| 4,428,505 | 1/1984 | Casey et al. | 222/64 |
| 4,573,417 | 3/1986 | Deve | 110/236 |

*Primary Examiner*—Jacques Louis-Jacques
*Attorney, Agent, or Firm*—Dorn, McEAchran, Jambor & Keating

[57] ABSTRACT

A process to determine the optimal initial settings for a series of timers in a timed-contribution batch process, based on the feed material flow rate and the composition of the material. The optimum initial timer arrangement is that which results in the maximum possible product output in the shortest possible batch time; this condition is realized when all of the minimum product requirements, as determined by the minimum timer settings, are satisfied at approximately the same time. The process first monitors the accumulation rates of the various constituents of the feed material for a discrete period of time, during which time a sensing device records the individual accumulation rates. Values representing the accumulation rates are normalized to the value of the greatest accumulation rate. A multiplier is applied to the resulting ratios to determine the optimal initial minimum timer settings. The maximum timer settings may be arithmetically or algebraically derived from the minimum timer settings. This method allows the operator to make manual adjustments, which sacrifice a percentage of the product yield for the sake of product composition control, from the starting point of maximum production.

10 Claims, 5 Drawing Sheets

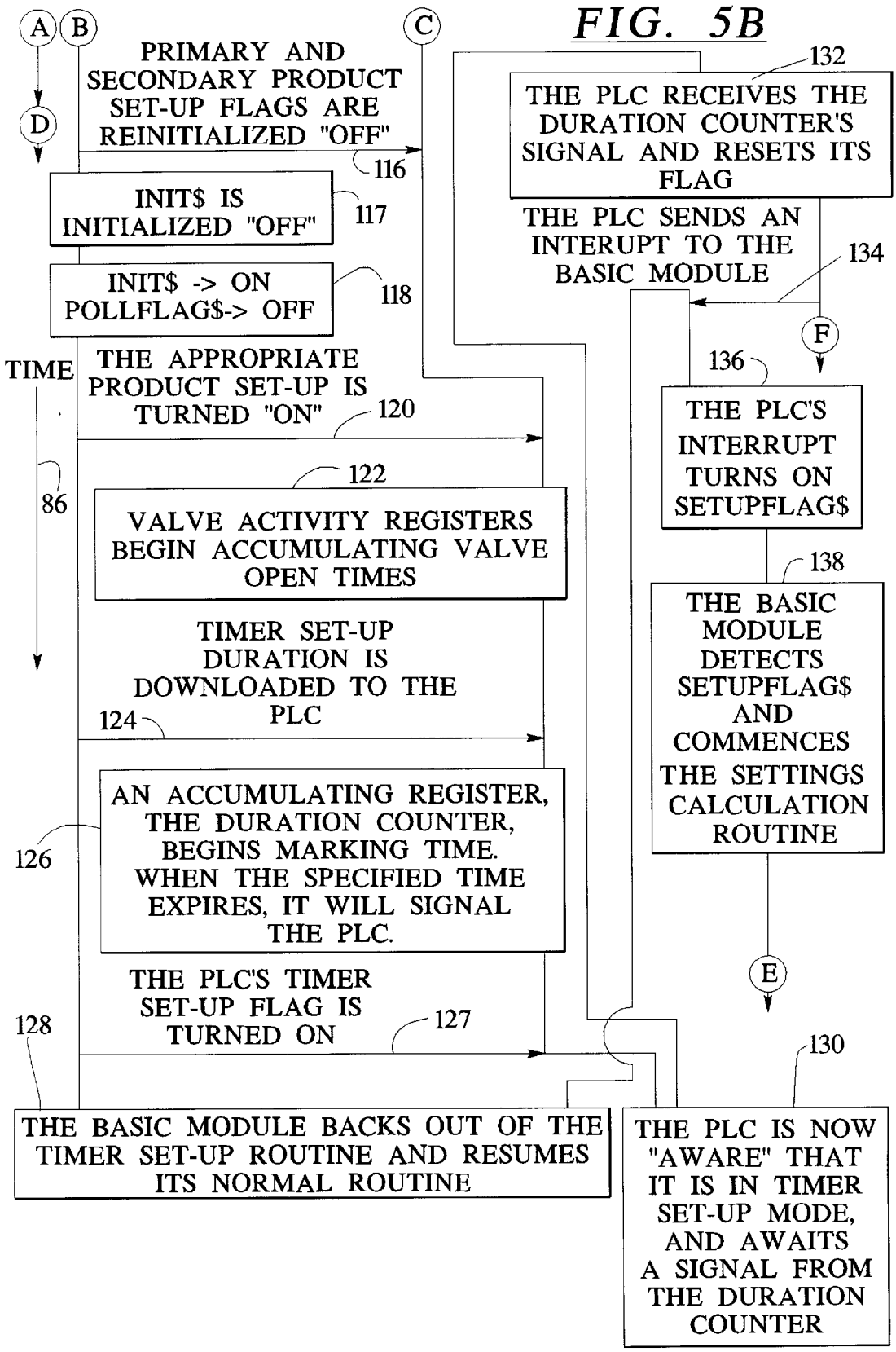
FIG. 5B
A
B
C
D
PRIMARY AND SECONDARY PRODUCT SET-UP FLAGS ARE REINITIALIZED "OFF"
116
INIT$ IS INITIALIZED "OFF"
117
INIT$ -> ON POLLFLAG$-> OFF
118
TIME
THE APPROPRIATE PRODUCT SET-UP IS TURNED "ON"
120
86
122
VALVE ACTIVITY REGISTERS BEGIN ACCUMULATING VALVE OPEN TIMES
TIMER SET-UP DURATION IS DOWNLOADED TO THE PLC
124
AN ACCUMULATING REGISTER, THE DURATION COUNTER, BEGINS MARKING TIME. WHEN THE SPECIFIED TIME EXPIRES, IT WILL SIGNAL THE PLC.
126
THE PLC'S TIMER SET-UP FLAG IS TURNED ON
127
128
THE BASIC MODULE BACKS OUT OF THE TIMER SET-UP ROUTINE AND RESUMES ITS NORMAL ROUTINE
132
THE PLC RECEIVES THE DURATION COUNTER'S SIGNAL AND RESETS ITS FLAG
THE PLC SENDS AN INTERUPT TO THE BASIC MODULE
134
F
136
THE PLC'S INTERRUPT TURNS ON SETUPFLAG$
138
THE BASIC MODULE DETECTS SETUPFLAG$ AND COMMENCES THE SETTINGS CALCULATION ROUTINE
E
130
THE PLC IS NOW "AWARE" THAT IT IS IN TIMER SET-UP MODE, AND AWAITS A SIGNAL FROM THE DURATION COUNTER

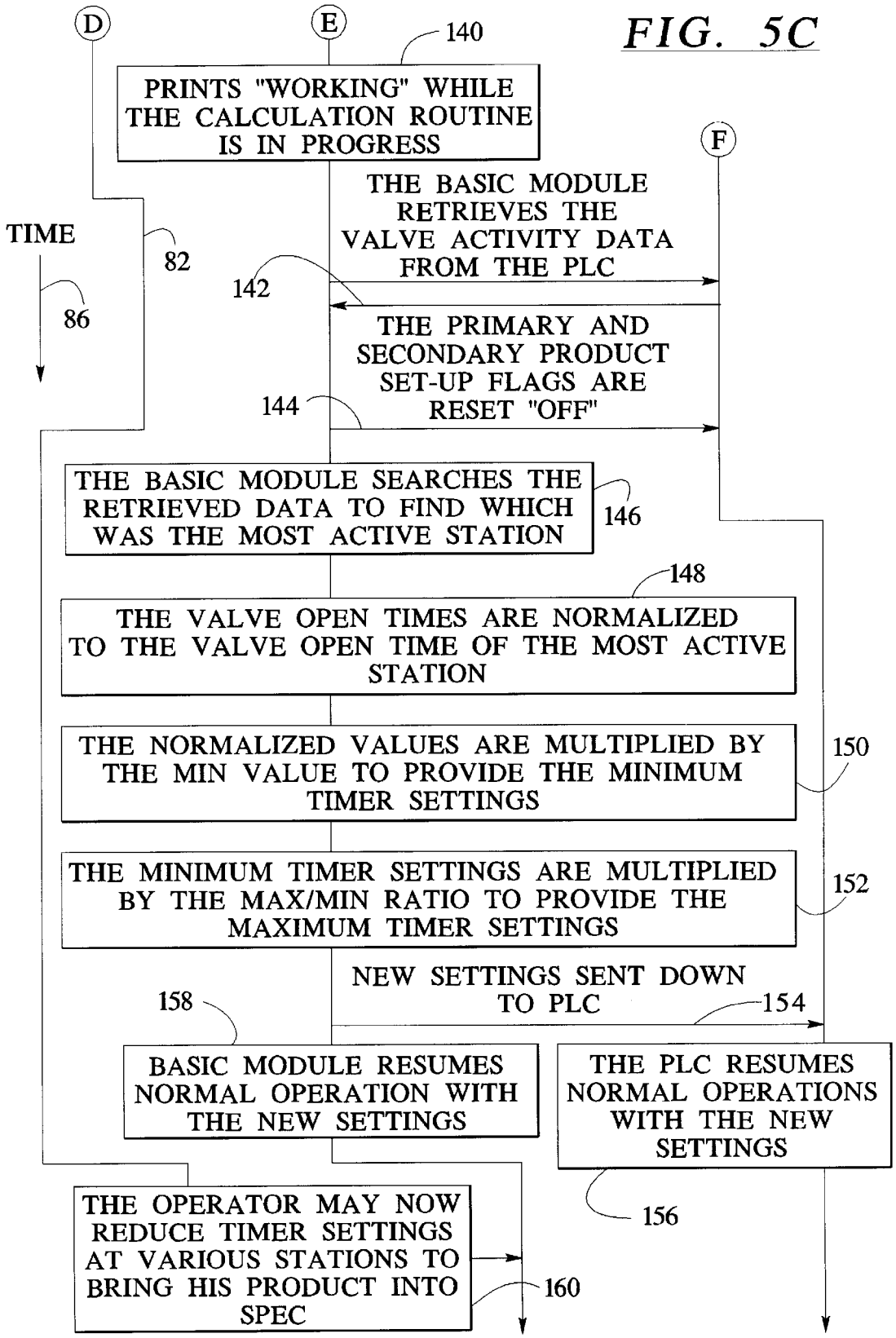
FIG. 5C
D
E
F
140
PRINTS "WORKING" WHILE THE CALCULATION ROUTINE IS IN PROGRESS
TIME
82
86
THE BASIC MODULE RETRIEVES THE VALVE ACTIVITY DATA FROM THE PLC
142
THE PRIMARY AND SECONDARY PRODUCT SET-UP FLAGS ARE RESET "OFF"
144
THE BASIC MODULE SEARCHES THE RETRIEVED DATA TO FIND WHICH WAS THE MOST ACTIVE STATION
146
148
THE VALVE OPEN TIMES ARE NORMALIZED TO THE VALVE OPEN TIME OF THE MOST ACTIVE STATION
THE NORMALIZED VALUES ARE MULTIPLIED BY THE MIN VALUE TO PROVIDE THE MINIMUM TIMER SETTINGS
150
THE MINIMUM TIMER SETTINGS ARE MULTIPLIED BY THE MAX/MIN RATIO TO PROVIDE THE MAXIMUM TIMER SETTINGS
152
NEW SETTINGS SENT DOWN TO PLC
158
154
BASIC MODULE RESUMES NORMAL OPERATION WITH THE NEW SETTINGS
THE PLC RESUMES NORMAL OPERATIONS WITH THE NEW SETTINGS
156
THE OPERATOR MAY NOW REDUCE TIMER SETTINGS AT VARIOUS STATIONS TO BRING HIS PRODUCT INTO SPEC
160

BATCH TIMER INITIALIZATION FOR A SAND CLASSIFYING TANK

BACKGROUND OF THE INVENTION

In a sand classifying tank, a slurry of sand and water is introduced into one end of an elongated tank. The water flows to the other end of the tank and out over a weir, carrying with it soluble clays and other impurities. The settling of particulate matter from the slurry is a function of specific gravity, with sand of higher specific gravity settling out more quickly than sand of lower specific gravity. In practice, the general result is that larger particles of sand settle to the bottom of the tank near the input end, and progressively finer particles settle out toward the opposite, or overflow end of the tank. A series of valve stations for discharge of sand are spaced longitudinally along the bottom of the tank. These valve stations, commonly referred to as classification stations or settling stations, are strategically spaced such that each station will discharge a desired gradation of sand when the tank is in proper operation. Sand is permitted to accumulate to a substantial depth at each station and is then discharged to one or more reblending flumes through a set of valves at each station. The tank typically includes first and second flumes for blending controlled specification products and a third flume for an uncontrolled residual product.

The valves are opened in accordance with a timing control, which limits the contribution each valve can make to any one batch of a controlled product. Tanks of the type described are shown in Keeney, U.S. Pat. No. 3,114,479, Cochran, U.S. Pat. No. 3,160,321, and Keeney, U.S. Pat. No. 4,199,080, the disclosures of which are incorporated herein by reference.

In the Cochran system, the specification products are produced in a series of batches. The quantitative ratio between the amounts of sand discharged from the various classification stations to each specification product is determined by a set of individual timers for each classification station. Maximum and minimum timers for each station define a window, or range of valve-open times that will contribute an allowable amount of sand to the specification product. In other words, for the product to remain within specifications, that product's valve at each valve station must be open at least the amount: of time specified by the minimum timer, but no more than the amount of time specified by the maximum timer. All minimum timers for each controlled product must time out before a new batch of that product is started. When all of the minimum timers for a product have timed out, or batched, the timers are re-set and the next batch cycle begins. The batches are made continuously so that as soon as one batch ends, the next one begins.

A specification for a given sand product is typically based on standards established by the American Society for Testing Materials (ASTM), the Department of Transportation (DOT) for the state in which the product is to be used, the Army Corps of Engineers, or a similar controlling agency. Sand classification tanks of the type described by Cochran and Keeney are particularly well suited to work with specifications that prescribe gradation limits. These standards prescribe the percentage by weight of each grade, or size, of sand that is allowable in a given product. When given in the context of sieve analysis, the allowable percentages are described in terms of either percentages retained on sieves of prescribed mesh sizes, or in terms of the cumulative percentage passing said sieves. By controlling the length of time a given valve is contributing its grade of sand to a product, the Cochran controller can keep the percentage of that grade of sand within the range of percentages allowed by the product specification. By keeping each batch within the specifications, the Cochran controller keeps the entire product stockpile within the specifications.

Determining the initial settings for the maximum and minimum timers has been a problem in the past. There are several reasons for this. To understand the problems, however, it is best to first understand some of the considerations that go into determining the initial settings. It is best to start with the basics, so let us begin by considering the purpose for initializing the timers prior to entering the final settings. The primary aim of a timer initialization routine, be it manual or automatic, is to approximate, as nearly as possible, a simultaneous batching of all the minimum timers (due to variances in the accumulation rates of the various grades of sand, a truly simultaneous batching of all the timers is extremely improbable).

The word "batch ", used in this context, refers to the event of a minimum timer reaching its setting. This is derived from the fact that when a minimum timer has counted up to (or down from) its assigned value, then the valve which the timer represents has satisfied its required minimum contribution to the current batch, or discrete portion, of the product. When all the stations have "batched " or met their minimum timer settings, that batch is considered completed and the timers are re-set to immediately begin the next batch for that product.

Simultaneous batching carries with it several implications that make it desirable. If all the minimum timers are batching at once, that means that no stations are wasting potential product sand while they are waiting for the laggard stations to catch up. That implies both minimum waste of profit, and maximum production.

An even greater benefit is that simultaneous batching over a period of time provides the best indication of how much of each grade of sand is available. This is because the ratios between the various timer settings will be a direct reflection of the ratios between the sand accumulation rates at the corresponding valve stations. To understand what this implies, consider first that the purpose of a sand classifying tank is to separate the constituent grades within the feed sand as completely as possible. This is done so that excesses of certain grades can be bled off from various valve stations to bring the product within contract specifications. A sand plant operator periodically conducts a sieve analysis of the discharge from each valve station so that he may know which grades of sand are settling at which stations. If the operator also knows how much sand is available at a valve station, he then can determine how much valve-time he must delete at that station, if any, in order to produce a specification product.

Another thing to consider while initializing the timers is how long the incoming feed should be observed before the flow information is used to calculate the initial timer settings. It is desirable for the observation period to be long in relation to any anticipated fluctuations in the feed. That reduces the probability that the initial settings will be unduly influenced by non-representative feed.

If the timer-initialization considerations described above are understood, one has only to look at the previous controller itself to see the origin of many of the problems that were encountered during timer set-up. Controllers prior to the present invention had no means of recording valve-open times over a time period spanning multiple batch cycles. This constrained all efforts to obtain accurate flow information, because the information had to be garnered from several individual batch cycles, then pieced together and averaged. This forced the operators of previous sand tank controllers to forgo more direct, intuitive methods, and imposed a hardware-specific algorithm for computing initial settings. These algorithms relied heavily on operator accuracy and operator math skills, and often provided only the roughest approximation of simultaneous batching. However, they did provide better results than the shotgun approach to determining settings, which involved an initial guess, followed by hours, or even days, of adjusting the timers in an effort to find an acceptable combination of timer settings.

One initialization routine, representative of the prior art algorithms referred to above, was a multi-step, manual procedure. The operator would first set all of the maximum and minimum timers to some arbitrary initial settings, typically 150 and 100 seconds, respectively. The tank would be run and, with pencil and paper in hand, the operator would watch for the fastest minimum timer to "zero out". When that happened, the operator would write down all the rest of the minimum timer values as quickly as possible to capture a snapshot view of the accumulated times. This procedure was usually repeated three or more times so that average values could be calculated.

With the average value for each station determined, the operator would subtract that value from the arbitrarily chosen minimum timer setting with which he started. The resulting difference was the value to be used as the initialized minimum timer setting for that station. The initial maximum timer setting was generally taken to be twice the minimum setting. When the timers were set to the values thus calculated, the minimum timers would all batch at roughly the same time. Once the initialized settings were obtained, the operator could reduce timer settings at various stations, as necessary, to bring his product within specifications. Such an initialization routine was relatively effective, but it was not what would be termed a simple endeavor.

SUMMARY OF THE INVENTION

The present invention is concerned with setting up the control system of a sand classifying tank, and is particularly concerned with providing initial settings for the maximum and minimum timers to establish a framework from which further adjustments can be made to bring the product into specification.

A primary object of the invention is an initialization routine for a sand classifying tank which greatly reduces the amount of time required to set up a sand classifying tank and produce specification products therefrom. To illustrate the magnitude of the improvement, former methods took many hours, or even days; the current invention usually allows timer configuration for a given product to be obtained in less than an hour.

Another object of the invention is an initialization routine which can operate over many batch cycles. This allows the controller to employ mathematics that are more direct and more intuitive than the calculations employed by prior systems.

A further object of the invention is an initialization routine that can be run while a forcing timer is in operation. A forcing timer is a means of diverting a portion of the incoming feed to the secondary product. When a level sensor signifies there is sufficient sand at a station to warrant opening a valve, the primary product valve is opened unless the maximum timer for that product has timed out. If so, sand is supplied to the secondary product, unless its maximum timer has also timed out, in which case the sand is discharged to the waste flume. If a forcing timer (also referred to as a proportion control and a product ratio control in the Cochran patent) is in use, then the primary and secondary product valves may be opened concurrently. This is often the only way in which a secondary product can be produced, for it is not uncommon for the primary product to have the capacity to utilize most or all of the sand at several classification stations. Should this be the case, and if there were no way to provide the secondary product with the necessary gradations of sand, the secondary product might be precluded from ever finishing a single batch.

These and other objects are realized in a sand classifying tank of the kind having a series of stations at which different gradations of sand accumulate at rates dependent on the feed supplied to the tank. Each station typically has primary and secondary product valves for discharging sand to primary and secondary controlled product flumes. More valves could be incorporated at each station should this prove advantageous for a particular application. Each station also has a valve which discharges an uncontrolled product into a third flume. Level sensors, one for each station, actuate the valve stations to discharge material whenever the sand has accumulated to a given depth. Maximum and minimum timers are provided for each station for both the primary and secondary products.

The initialization process includes the steps of inputting and storing operator-selected values of a set-up routine duration limit, a standard ratio of maximum-to-minimum timer settings, and a base minimum timer setting. Then all of the minimum timers for the products being initialized are set to zero, and all the maximum timers are set to a pre-determined preliminary setting, e.g., 100 seconds.

The tank is allowed to run while a set-up routine time counter accumulates the amount of time since the start of the run. Another set of counters keeps track of the total sensing paddle stall-time, which is the equivalent of the total valve-open time, at each station. These times are accumulated until the set-up time counter reaches the set-up duration limit. The valve-open time data is then loaded into a computer, along with the standard maximum-to-minimum ratio and the base minimum timer settings. Different means for recording flow information, other than recording sensing paddle stall-time, may be utilized.

In the computer, the valve-open time data is sorted to identify the most active station. All other station valve-open times are normalized to the most active station. In other words, the computer divides all of the accumulated valve-open times by the maximum valve-open time. The normalized valve-open times are then multiplied by the base minimum timer setting to produce the initialized minimum timer settings. These settings are applied to all of the minimum timer settings for that product. The computer also multiplies the initialized minimum timer settings by the standard maximum-to-minimum ratio to produce the initialized maximum timer settings. These settings are applied to the maximum timers for that product. From this point the operator can determine which stations have excess sand of a particular gradation, and the number of seconds by which the valve times at those stations must be reduced in order to make a specification product.

BRIEF DESCRIPTION OF THE DRAWINGS

FIGS. 5A, 5B and 5C comprise a flow chart describing the steps of the initialization system of the present invention.

DETAILED DESCRIPTION OF THE INVENTION

Figure 1:
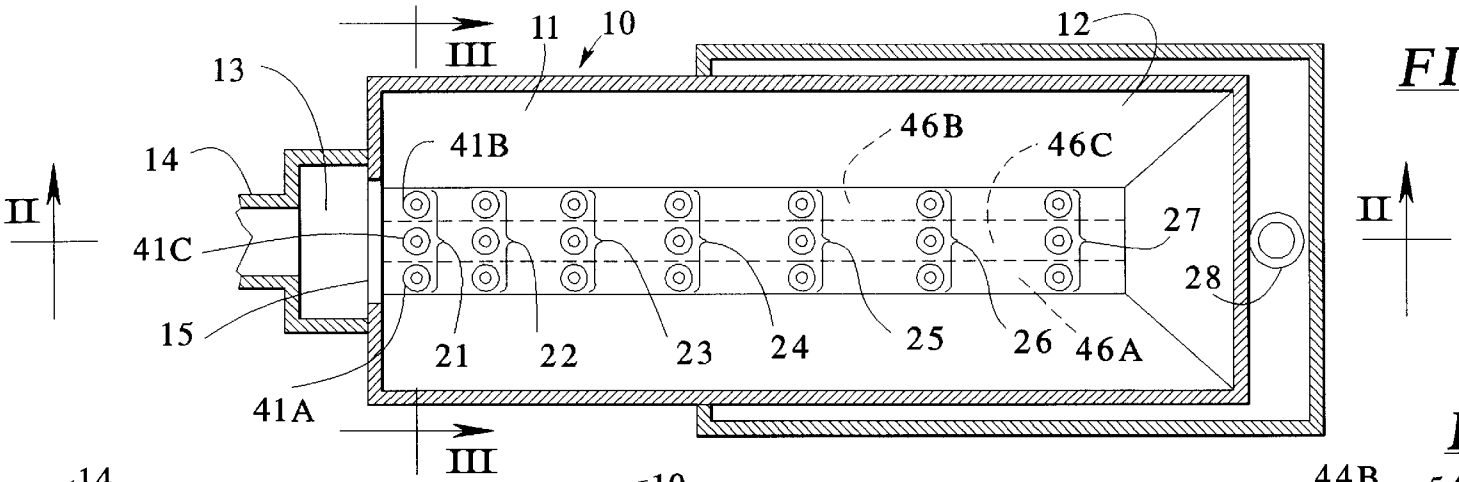
FIG. 1 is a simplified sectional plan view of one form of sand classifying tank with which the timer initialization system of the present invention may be utilized, taken approximately along line 1—1 in FIG. 2.
Figure 3:
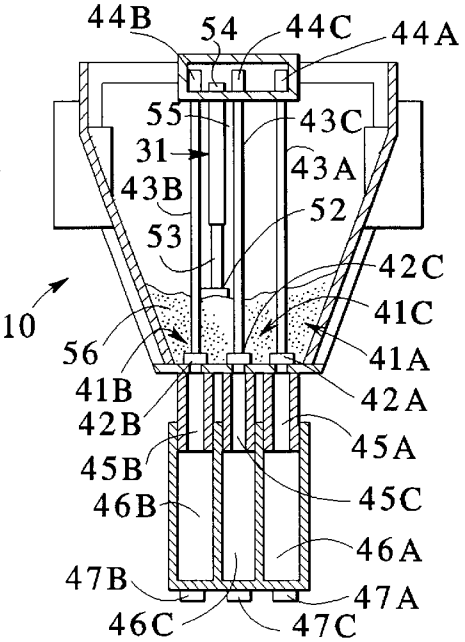
FIG. 3 is a transverse sectional elevation view taken approximately along line 3—3 of FIG. 1.
Figure 2:
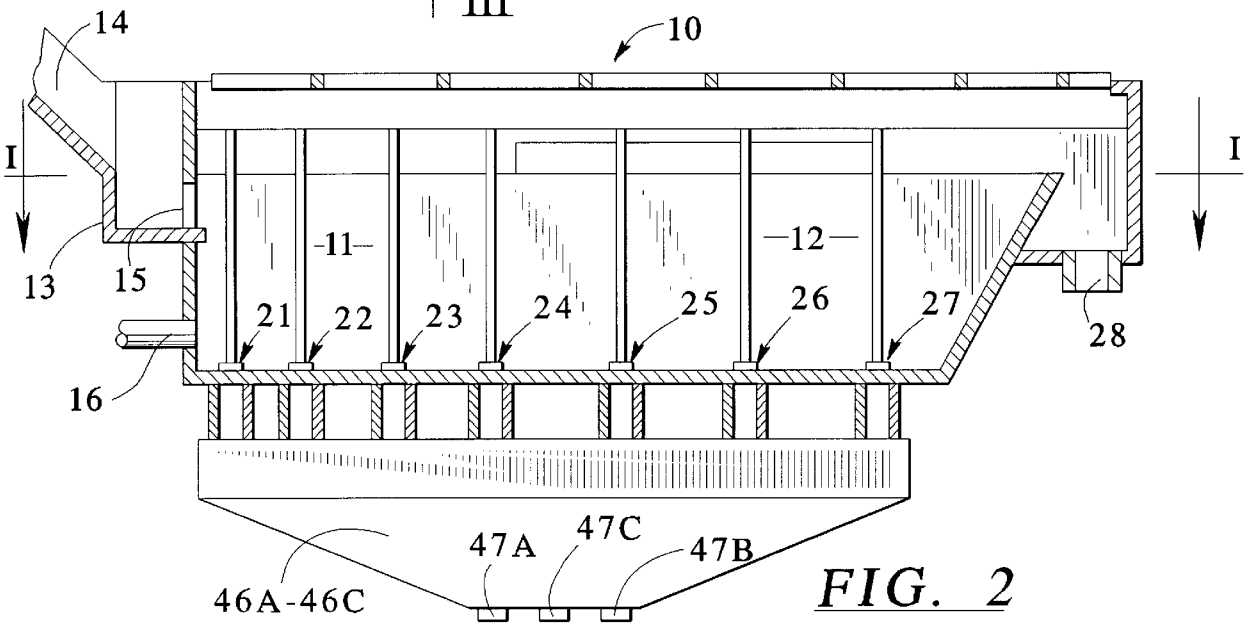
FIG. 2 is a simplified sectional elevation view of a sand classifying tank taken approximately along line 2—2 of FIG. 1.

FIGS. 1–3 illustrate in simplified form a water-scalping/sand classifying tank of the type on which the initialization system of the present invention is used. The tank 10 uses the same basic construction as described in the Keeney and Cochran patents mentioned above. The tank includes an input or coarse sand section 11 and an overflow or fine sand section 12. A feedbox 13 is mounted on the end of the input section 11. An input conduit 14 is connected to the feedbox and an opening 15 leads from the feedbox into the tank section 11. The tank may also have an auxiliary water inlet 16 as shown in FIG. 2.

Tank 10 has seven classification stations 21–27, displaced from each other along the bottom of the tank from the inlet end 11 to the overflow end 12. At the overflow end of the tank, there is an overflow conduit 28 for removing excess water from the tank. It will be understood that the tank may have more or fewer classification stations as needed for a particular application. All of the sand classification stations 21–27 are essentially similar in construction.

A typical station 21, as shown in FIG. 3, includes a level sensor 31 for sensing the presence of a sufficient accumulation of sand to allow discharge of relatively dry sand from the classification station at a relatively constant rate for at least a minimum time interval entailed in opening and closing a discharge valve. Sensor 31 may be of conventional construction, comprising a sensing paddle 52 mounted on the lower end of a shaft 53 that projects vertically through the section of the tank in which station 21 is located. Shaft 53 extends through a guard 55 and is connected to a stall motor 54 that continuously drives the shaft.

Whenever there is a sufficient accumulation of sand 56 to prevent the continuing rotation of the sensing paddle 52, the torque normally applied to rotate the paddle will be transferred to the stall motor 54. The ball bearing-mounted housing of the stall motor 54 is capable of rotating through a limited arc, but in normal operation it is kept from doing so by a restraining spring (not shown). When the torque transferred from the stalled paddle 52 exceeds the resisting force of the restraining spring, it will cause a counter-rotation of the stall motor 54. The stall motor 54 is electrically or mechanically connected to a sensing switch (not shown) which is actuated by the rotation of the stall motor 54. This arrangement is illustrated in FIG. 3 of Cochran, U.S. Pat. No. 3,160,321. In this manner, the level sensor 31 develops an electrical signal, referred to herein as a discharge signal, whenever the material 56 has accumulated to a depth sufficient to permit discharge of relatively dry sand from the classification station 21; whenever the sand supply 56 is depleted to a level at which the sensing paddle 52 can resume rotation, the discharge signal is terminated. Each of the other classification stations 22–27 is provided with a level sensor like the level sensor 31 for station 21.

The typical classification station 21 (FIG. 3) includes sand discharge means comprising three individual outlet valves 41A, 41B and 41C in the bottom of tank 10. Valve 41A comprises a valve closure member 42A connected to an operating rod 43A that extends upwardly through the tank and is connected to a solenoid-operated hydraulic valve actuator 44A. Similarly, valve 41B comprises a valve closure member 42B connected to an operating rod 43B that is in turn connected to a valve actuator 44B. Valve 41C is similar. Valves 41A–41C are individually connected to three outlet conduits 45A, 45B and 45C, respectively.

Reblending of sand from tank 10 takes places in two controlled product reblending flumes 46A and 46B and in an auxiliary or waste flume 46C for sand not utilized by the controlled products. As shown in FIGS. 1 and 3, flume 46A is aligned with the discharge valve 41A at station 21 and with a similarly situated outlet valve at each of the other classification stations 22–27. In a like manner, flume 46B is aligned with valve 41B and with its own individual outlet valve at each classification station. Residual flume 46C is aligned with the central outlet valve at each station of the tank. Individual outlets 47A, 47B and 47C are provided for the reblending flumes 46A–46C (FIGS. 2 and 3).

In operation, a slurry of sand and water is fed into feedbox 13 through conduit 14 and flows into tank 10 through opening 15. Additional water may be supplied to the tank through conduit 16. As the slurry flows out of opening 15, the heavier particles settle most rapidly toward the bottom of the tank. Finer particles settle out more slowly and silt particles do not settle out at all, but are instead washed out over the weir with the waste water. In this manner sand accumulates on the bottom of the tank, the largest sand particles accumulate at the initial classification stations 21 and 22 and the finest sand settling out at the final classification station 27. The actual number of classification stations in the tank may vary, depending on the length and capacity of the tank. In most commercial installations, the number of stations is between six and twelve. With the flow of sand and water properly balanced, virtually all of the sand settles to the bottom of the tank and the overflow of water into outlet conduit 28 is essentially free of sand.

When the classification tank 10 is in operation, all of the sensor motors, such as motor 54 of sensor 31 (FIG. 3) are energized. These motors rotate the paddle sensors relatively freely in the water. With particular reference to station 21, the sand accumulation 56 eventually reaches a level at which it interferes with rotation of the sensing paddle 52. When this occurs, motor 54 stalls and actuates a sensing switch, thereby developing a discharge signal. This discharge signal operates one or more of the valve actuators 44A–44C, opening at least one of the outlet valves 41A–41C. The resulting discharge into at least one of the flumes 46A–46C reduces the level of sand at station 21 and eventually frees paddle 52 for continuing rotation. As soon as paddle 52 resumes rotation, the discharge signal is interrupted and the discharge valves are closed so that additional sand can accumulate at station 21. This process continues throughout the operation of the tank, at each of the classification stations 21–27, with each station individually controlled by its own level sensor.

Figure 4:
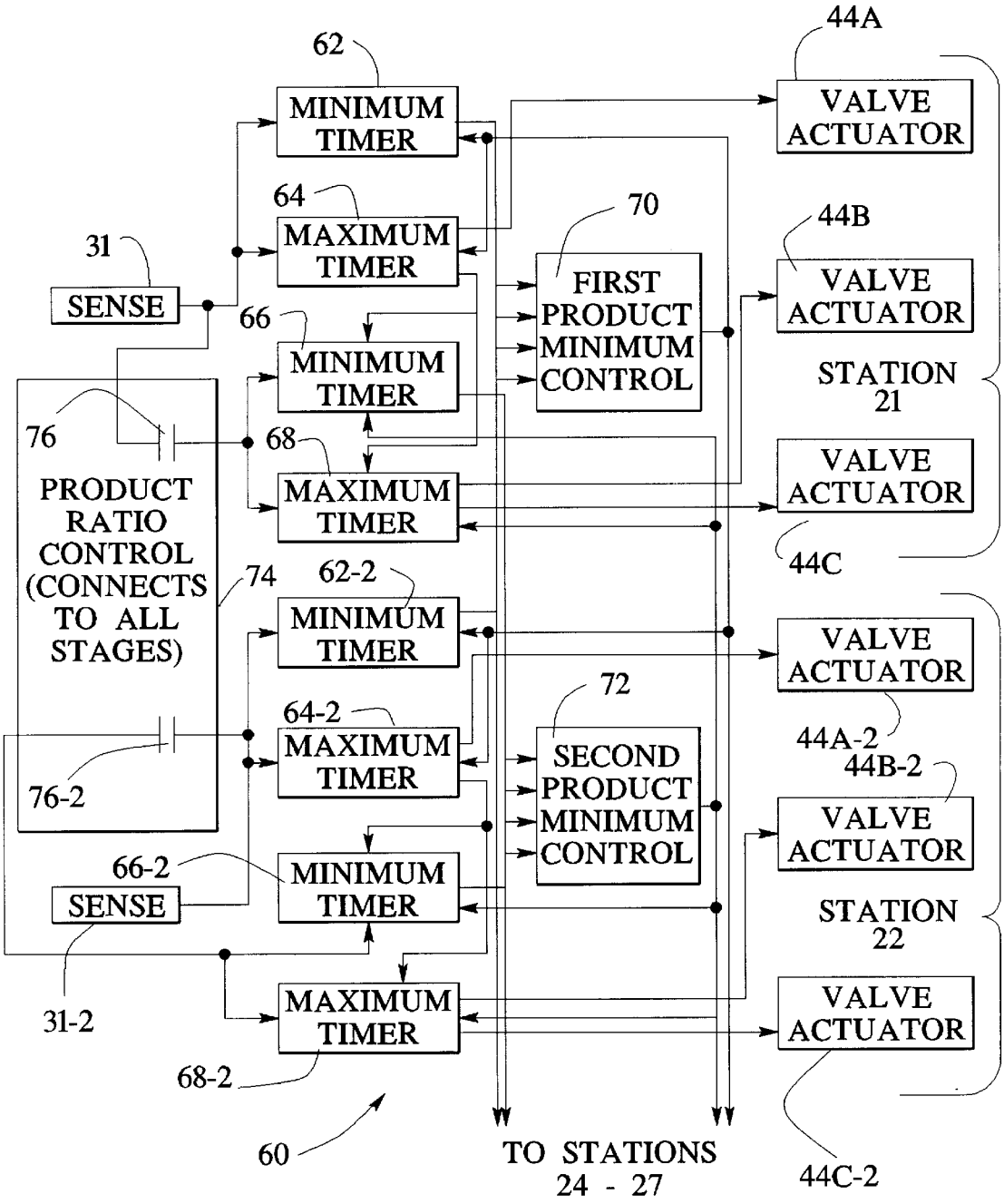
FIG. 4 is a block diagram of a control system suitable for use with the tank of FIGS. 1–3.

FIG. 4 is a simplified block diagram of a control system for the classification tank. In this diagram, electrical and hydraulic power supplies, as well as the paddle motors have not been illustrated since these items are shown in the patents referred to above. Also, the controls for only two of the stations are shown, the other stations being substantially similar.

The control system 60 includes the sensing device 31 connected to a first product minimum timer 62 and to a first product maximum timer 64. Outputs from maximum timer 64 connect the sensing device 31 to a second product minimum timer 66 and to a second product maximum timer 68. Timer 64 is also connected to the valve actuator 44A that controls discharge of sand through the first product valve 41A. The valve actuator 44A is also controlled from the minimum timer 62 through a first product minimum control circuit 70 that is connected to all stages of the control system 60.

The second product maximum timer 68 is provided with one output circuit connected to the valve actuator 44B for the second discharge valve 41B. Actuator 44B controls the discharge to the second specification product. The same timer 68 also has a second output connected to the valve actuator 44C that actuates the waste discharge valve 41C. The second product minimum timer 66 is connected to actuator 44B through a second product minimum control circuit 72. Thus, valve actuator 44B is controlled by both of the timers 66 and 68 as explained in detail below.

The basic control circuit for the second station 22 is essentially the same as that for station 21. Thus, it has a first product minimum timer 62-2 and a first product maximum timer 64-2. There is also a second product minimum timer 66-2 and a second product maximum timer 68-2. These are connected as shown to valve actuators 44A-2, 44B-2, and 44C-2.

It should be noted that there is only one minimum timer control circuit 70 for the first product. The circuit 70 is provided with an input connected to each of the first product minimum timers 62, 62-2, et seq. Similarly, there is only one minimum timer control circuit for the second product. Circuit 72, which utilizes input signals from each of the second product minimum timers 66, 66-2, et seq.

The control system 60 also includes a product ratio control unit 74, also known in the art as a forcing timer. The forcing timer is connected to all stations of the system. Forcing timer 74 has a circuit connecting sensors 31, 31-2 et seq to the corresponding second product timers 66, 68, at each station. Each such operating circuit includes at least one set of control contacts exemplified by contacts 76 and 76-2. The forcing timer 74 may constitute any desired apparatus capable of opening and closing the control contacts 76 and 76-2. The forcing timer provides a means for adjusting the quantity of the second specification product relative to the primary or first product.

In operating the control system 60 of FIG. 4, timer 62 is initialized for a minimum quantity of material required to be discharged from the initial discharge station 21 of the tank. Timer 64 is set for a maximum quantity of this same material in the first specification product. The second product minimum timer 66 is set for the required minimum discharge of material from station 21 to the second specification product. Again, the maximum timer 68 affords a limit on excess discharge of the material from station 21 into the second product, defining a tolerance range or window for material from this station in the second specification product. Corresponding settings are required for the individual timers at stations 22–27, each station being set for both minimum and maximum levels to be discharged into both the first and second product flumes. These initial settings for the minimum and maximum timers are set by the initialization system of the present invention.

When the system is placed in operation, and after a quantity of sand has accumulated in the bottom of the tank, the sensing device 31 registers the accumulation of sufficient sand to permit a discharge at station 21. When this occurs, the two first product timers 62 and 64 are energized and an operating circuit is established, through timer 64, energizing the valve actuator 44A to open the first product discharge valve 41A. Accordingly, sand is discharged through the valve 41A and into the first product flume. Assuming that contacts 76 are open, neither of the valve actuators 44B or 44C is energized, and there is no discharge either to the second specification product or to the waste flume. This action continues on an intermittent basis, dependent on the build-up of sand at station 21, until the minimum timer 62 times out.

Assuming that minimum timer 62 is the first timer in the control system 60 to complete its operating cycle, the associated maximum timer 64 maintains the first-product valve actuator 44A at this station in operation even though the minimum timer 62 has timed out. But when the first-product maximum timer 64 completes its operating cycle, it operates to interrupt the energizing circuit to valve actuator 44A. That is, upon timing out the timer 64 switches from the output circuit connected to actuator 44A over to the output circuit connected to the second-product timers 66 and 68.

When the second-product minimum timer 66 has timed out, and again assuming that other minimum timing devices in the same series have not completed their respective cycles of operation, the maximum timer 68 maintains valve actuator 44B in operating condition, always assuming that sensing device 31 shows adequate sand at station 21. Thereafter, however, when timer 68 has completed its timing operation, the operating circuit for valve actuator 44B is opened to prevent further discharge of material from station 21 to the second-product specification flume. Timer 68, at this time, switches its output from actuator 44B to valve actuator 44C, thus discharging any further accumulation of sand at station 21 into the waste flume.

From the foregoing description, it will be seen that the maximum timers 64 and 68 afford the basic control for the valve actuators at each station. The minimum timers 62 and 66, and the other minimum timers in their respective series, however, have a definite and equally important function. When all the minimum timers for the first-product timing devices 62, 62-2, et seq., have timed out (i.e., "batched "), then the first product minimum control circuit 70 operates to re-set all of the first-product timers for another run. Stated differently, when the last of the minimum timers for the first specification product completes its timing operation, there is no substantial delay in starting the next first-product run at all stations, even though some or all of the maximum timers have not timed out. The same sort of control is afforded by the second-product minimum control 72. That is, when the last of the minimum timers 66, 66-2 et seq. times out, the system operates virtually instantaneously to re-set the timing controls for all of the valve actuators in the 44B series and prevent further discharge to the waste flume if any such discharge had taken place.

As operation continues, contacts 76 may be closed on a cyclic basis in accordance with the duty cycle for which the forcing timer is set. Whenever contacts 76 close, timers 66 and 68 are energized and a circuit is established from timer 68 to the second-product valve actuator 44B to open the second-product discharge valve 42B. Hence, during a part of the time only the first product receives material from station 21; at other times material may be discharged to both products; the time ratio being controlled by unit 74. The rate of discharge to the first product is not reduced when there is a discharge to the second product, since valves 41A–C are in parallel with each other. However, the increase in total flow caused by opening valve 41B does reduce the sand level faster, cutting off the flow when sensing device 31 shows insufficient sand available.

Figure 5A:
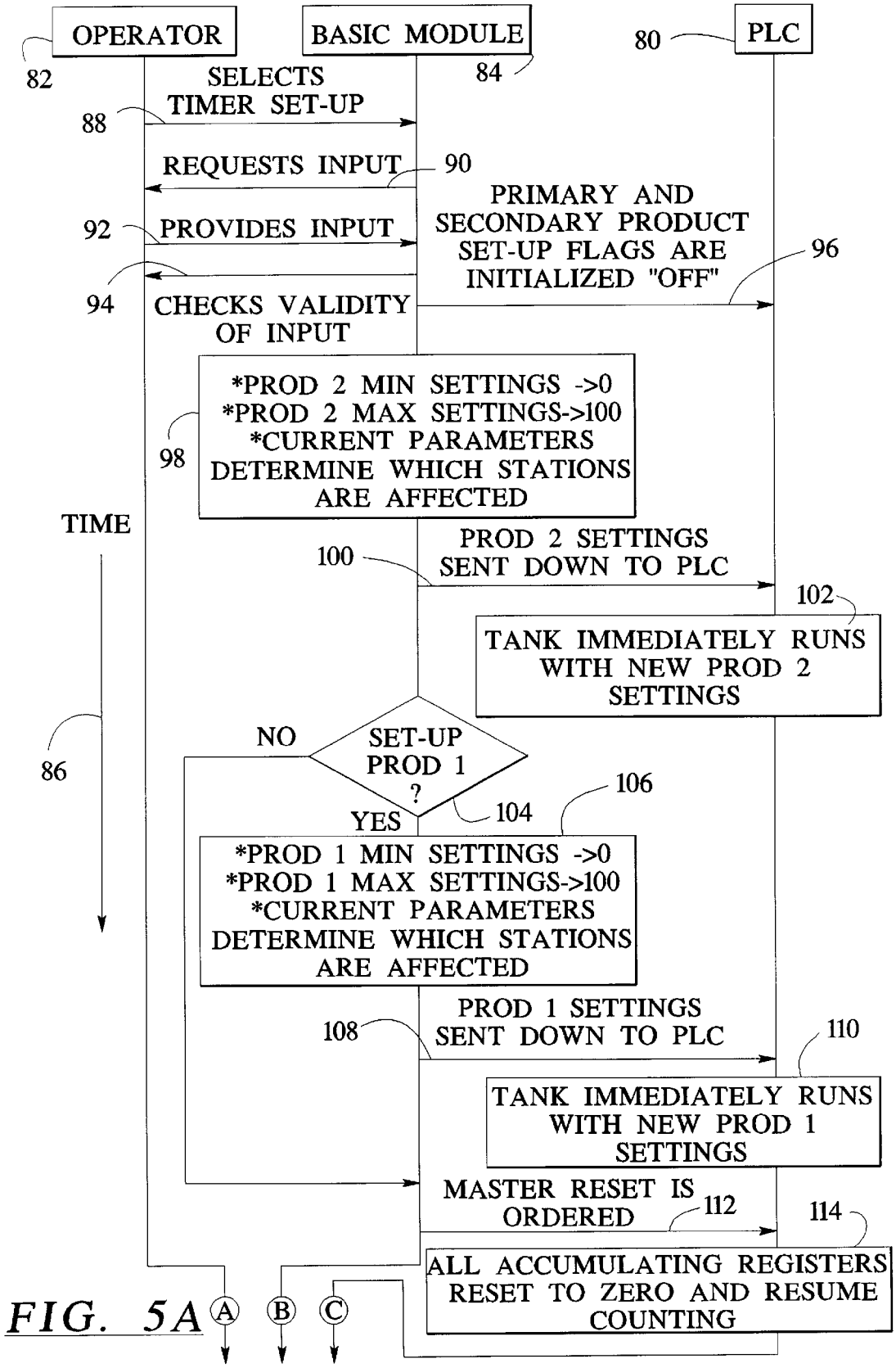

With the foregoing background, attention can now be drawn to the concerns of the present invention, namely, how to initialize the maximum and minimum timers for one or more products. The method and apparatus for doing this are shown in FIGS. 5A–5C. These figures illustrate a timer set-up flowchart, beginning in FIG. 5A and continuing in FIGS. 5B and 5C. Although the following description is given in terms of the invention's application in a specific classifying tank controller, it should be kept in mind that the invention can be adapted to virtually any type of classifying tank controller.

The hardware for the timer set-up apparatus includes three components: a programmable logic controller (PLC) shown at 80 in FIG. 5A, a command entry keypad 82 and a BASIC module, 84. The PLC 80 controls the valve solenoids and contains registers that accumulate valve-open times. The keypad 82 is the operator's means of communication with the BASIC module 84. The keypad allows the operator to select options and commands. The liquid crystal display (LCD) on the keypad also displays messages and information needed to run the sand plant. Physically, the BASIC module 84 is a component of the PLC. Functionally, the BASIC module is a small computer in its own right, and serves both as the PLC/operator interface, and as an interpreter for the data which the PLC accumulates, as described below. The batch timer self-initialization software resides primarily within the BASIC module 84. The flowchart of FIGS. 5A–5C describes events as they happen in time sequence, with time proceeding from top to bottom as indicated by arrow 86.

The set-up routine begins at 88 when the operator selects TIMER SET-UP from the keypad menu. When the BASIC module receives this request, it asks the operator for three pieces of information, 90. First, it asks the operator how long he would like to run the set-up procedure. The BASIC module proposes a default value of 30 minutes, which the operator can accept or reject. The BASIC module asks for a standard ratio of maximum to minimum timer settings, to be used in calculation of the initial maximum timer settings. It proposes a default of a standard ratio of 2:1. Finally, it asks the base minimum timer setting of the most active station, to which all of the other station timers will be proportioned. The BASIC module proposes a default base minimum timer setting of 50 seconds. Again, the operator can accept or reject the default.

As each parameter is provided by the operator (at 92) the BASIC module checks the validity of the operator-selected values based on parameters imposed by normal sand plant operation. This function is indicated at 94. The BASIC module already knows whether the primary or secondary product timers are to be configured, because the TIMER SET-UP ROUTINE was selected from within either the PRODUCT 1 display mode or the PRODUCT 2 display mode. The current display mode determines which product will be set up.

The controller is programmed to put all of the incoming feed it can into the primary product. Only when the primary product can accept no more of a given grade of sand is that grade offered to the secondary product. This is true unless the forcing timer is in use. The forcing timer is used to open both the primary and secondary product valves concurrently for a portion of the forcing timer's duty cycle, thereby "forcing" more sand into the secondary product. The controller's preferential treatment of the primary product imposes a certain restriction. The secondary product can be changed without affecting the primary product. However, if the primary product timers are reconfigured to produce a new product, the feed available to the secondary product will also change. Consequently, it is necessary to re-initialize the secondary product every time the primary product is initialized.

To assist the operator in recognizing the aforementioned restriction, the controller treats the products differently in the TIMER SET-UP routine. The secondary product timers are adjusted in the main portion of the set-up routine, shown at 98, whereas adjustment of the primary product timers is nested in a conditional statement, shown in steps 104–110. What this means is that the secondary product minimum timers are reset to zero and the secondary product maximum timers are set to 100 seconds every time TIMER SET-UP is run. If the timer initialization routine was invoked for the secondary product, these settings will be replaced by the new secondary product initial settings. If the primary product was the one selected for initialization, the zero and 100 second settings will become the new secondary product settings. The zero minimum timer settings will cause the secondary product to utilize all sand that is made available to it.

As stated above, if the primary product is initialized, it will also be necessary to run TIMER SET-UP for the secondary product. When the initialization routine is completed, the operator is left in the current product display mode. To set up the secondary product, the operator simply presses a P1/P2 key on the keypad, which toggles back and forth between PRODUCT 1 display mode and PRODUCT 2 display mode, and then retraces the steps he took to run TIMER SET-UP for the primary product.

Once the BASIC module has the information it requires, it can initialize the timers and run the sand classifying tank without further input from the operator. The next step taken by the BASIC module at 96 is to turn off the primary and secondary product set-up flags in the PLC. This is done by sending coded signals down to the PLC memory addresses that have been designated as the primary product and secondary product set-up flags.

Next, the BASIC module sets the secondary product minimum timer settings to zero and the secondary product maximum timer settings are set to a predetermined preliminary maximum setting, in this case 100 seconds. The BASIC module uses the classifying tank parameters with which it has been operating to determine which stations will be adjusted. The controller is capable of operating a tank with eleven stations and two metering bins, but it might be controlling a tank with as few as six stations and no metering bins. The BASIC module tailors the settings to the tank it is operating. These steps are indicated at 98.

The secondary product settings determined by the BASIC module at 98 are sent down to the PLC at 100. The PLC immediately begins running the tank with the new secondary product settings, 102. Meanwhile, the BASIC module at 104 determines whether the primary product settings are also to be initialized. If they are, then at 106 the BASIC module sets all primary product minimum timers to zero and primary product maximum timers to their preliminary settings, in this case 100 seconds. The primary product settings are then sent to the PLC at 108 and the PLC begins running the tank with the primary product settings, 110.

Regardless of which product is being initialized, the BASIC module next orders a master reset of all timers in the PLC, 112. The PLC's accumulating registers are reset to zero and they resume counting at 114. Turning now to FIG. 5B, the next step is to confirm that the primary and secondary product set-up flags are both off, shown at 116. At 117 a flag, INIT$, is initialized, and at 118 the flag is turned on. This flag resides in the BASIC module, and is checked elsewhere in the program to see if the initialization routine is being run. If during the TIMER SET-UP routine another routine is invoked that will invalidate the results of the set-up, the TIMER SET-UP routine will be ended and INIT$ will be turned off.

Next, the BASIC module sets a variable POLLFLAG$ to off. POLLFLAG$, when turned on, signals to the BASIC module that the PLC has completed its portion of the current polling cycle, or error-checking routine. If the PLC interrupt turned POLLFLAG$ on during this initial portion of the timer set-up, and if it were not reset to off before the program returned its attention to the main loop at 128, then it would generate an error message and shut down the timer initialization routine before the routine could have a chance to begin. The reason is that the first thing the BASIC module's error checking routine does is inspect the valve-open time counters for indications of excessive or abnormally low activity. The counters were just reset to zero at 114, and if POLLFLAG$ were on, the BASIC module would be fooled into thinking that either the feed to the tank had been interrupted, or that all the tank stations were inoperative. Step 118 is included to prevent any potential problems of this type.

Either the primary or the secondary product set-up flag is turned on at 120. The product set-up flags are used to tell the PLC which product timers it is initializing. When one of the product set-up flags is turned on, the PLC begins accumulating valve-open times in its valve activity registers, 122. At virtually the same time, the BASIC module sends the TIMER SET-UP duration to the PLC, 124, causing the duration counter to begin accumulating time, 126. A timer set-up flag 127 tells the PLC that it is now in timer set-up mode and that the PLC should await a signal from the duration counter.

In one embodiment the valve activity registers accumulate the time that any valve is open at a particular valve station. In other words, there is a register for each station that accumulates the paddle stall-time for that station. Paddle stall-time equals total valve-open time because whenever the sensing paddle stalls, at least one of the valves will be opened. An alternative arrangement would be to accumulate only the valve-open time for the valve of the product being initialized. Either arrangement would be acceptable. Actually, a signal from any type of level indicator can be used as an indication of the available feed.

Once either product set-up flag is turned on at 120, an accumulation phase begins. During the accumulation phase the BASIC module returns to its normal routine, 128, and the PLC awaits a signal from the duration counter that signifies the end of the accumulation phase. Tank operation is the same during the accumulation phase as it is during normal operation. Meanwhile, the duration counter counts the seconds until the timer initialization routine has run for the duration specified by the operator. The valve activity registers accumulate each station's activity for the entire period of the set-up routine. They record activity over a number of batching cycles, as opposed to earlier electromechanical timers that were only capable of recording activity over a single cycle.

When the duration timer times out, the PLC sends an interrupt to the BASIC module to let it know that the PLC is finished, 132, 134. When this signal is received, the interrupt from the PLC turns on SETUPFLAG$ in the BASIC module, 136. On the very next pass through the main loop, a conditional statement detects that SETUPFLAG$ is on, signifying that the PLC's portion of the TIMER SET-UP routine is completed. This begins the calculation phase of the set-up process, 138.

Turning now to FIG. 5C, the BASIC module places the message "WORKING" on the display screen, 140. The BASIC module then uploads the valve activity data from the PLC, 142, and resets the product set-up flags to off, 144.

Next, the BASIC module sorts through the values of valve-open times to identify the most active station, 146. The valve-open times for each station are then normalized to the most active station. In other words, the BASIC module divides all of the accumulated valve-open times by the maximum valve-open time. This is shown at 148. This produces ratios that represent the activity of each station relative to the most active station. The resulting ratios are then multiplied by the operator-specified minimum timer value to obtain the individual minimum timer settings, 150. The minimum timer settings may be rounded off and stored. The minimum settings are then multiplied by the operator-specified standard MAX/MIN ratio to produce the individual maximum timer settings. The maximum timer settings may also be rounded off and stored, 152.

The maximum and minimum timer settings stored in the BASIC module are downloaded to the PLC, 154, which immediately begins running on the new settings, 156. The BASIC module then returns its attention to its regular main loop and resumes normal operation, 158.

Once the initialization process is complete for either one or both products, the operator may adjust the initialized settings as shown in 160. The initialized timer settings tell the operator how many seconds of valve-time are available at each station so that the operator can determine how many seconds may be deleted at each station to bring the product within specifications.

There are several benefits to the initialization method and apparatus just described. Among these is the fact that the controller is not limited to single cycles. It can monitor valve activity for an arbitrary period of time that may span many batching cycles of arbitrary length. As previously stated, this allows the controller to employ mathematics that are both more direct and more intuitive than employed by prior systems. In addition to this simplicity, the system of the present invention does not rely on operator accuracy or operator math skills. This enables it to consistently achieve better results than are generally obtainable by manual adjustment. Further, these superior results are achieved in much shorter times than were previously possible.

Typically, timer-initialization and subsequent adjustments for a new product specification can be achieved in an hour or two with the current invention. In contrast, manual systems frequently require a full day or more to reconfigure product timers.

Whereas a preferred form of the invention has been shown and described, it will be realized that alterations may be made thereto without departing from the scope of the following claims.

I claim:

1. In a sand classifying tank or like apparatus for classifying granular material, of the kind including a series of classification stations at which different gradations of material carried by an incoming feed accumulate at varying rates, each station having at least one controlled product valve for discharging material to at least one controlled product and an auxiliary valve for discharging material to an uncontrolled residual product, the classifying tank further comprising a series of level sensors, one for each classification station, each level sensor actuating the valves at its classification station to discharge material whenever material has accumulated to a given level at that station, and product control means for continuously controlling the relative amounts of material discharged through the controlled product valves of the classification stations to produce controlled product of predetermined constituency, within given tolerances, the product control means including maximum and minimum timers for each station, the improvement comprising a method for initializing the maximum and minimum timers, comprising the steps of:

inputting and storing in the data storage means of a computing means operator-selected values of a set-up duration limit, a standard ratio of maximum-to-minimum timer settings, and a base minimum timer setting;

setting all minimum timers to zero and all maximum timers to a predetermined preliminary maximum setting;

starting a set-up time counter that will determine how long the incoming feed will be monitored during operation of the tank;

counting and storing in a data storage means total valve-open time for at least one valve at each station from the time the timer initialization routine begins until the time the set-up time counter reaches the set-up duration limit;

loading the valve-open time data into the computing means;

in the computing means, sorting the valve-open time data to identify the most active station, normalizing all other station valve-open times to the time of the most active station, multiplying the normalized valve-open times at each station by the base minimum timer setting to produce initialized minimum timer settings, multiplying the initialized minimum timer settings by the standard maximum-to-minimum timer ratio to produce initialized maximum timer settings; and re-setting the maximum and minimum timers of each station to the initialized maximum and minimum timer settings for that station.

2. The method of claim 1 wherein the inputting and storing step is further characterized by presenting default choices for the operator-selected values to the operator.

3. The method of claim 1 wherein the step of counting and storing the valve-open times is characterized by storing the time that any valve at a station is open.

4. In a sand classifying tank or like apparatus for classifying granular material, of the kind including a series of classification stations at which different gradations of material accumulate at varying rates, each station having first and second controlled product valves for discharging material to first and second controlled products and an auxiliary valve for discharging to an uncontrolled residual product, the classifying tank further comprising a series of level sensors, one for each classification station, each level sensor actuating the valves for its classification station to discharge material whenever material has accumulated to a given level at that station, and product control means for continuously controlling the relative amounts of material discharged through the controlled product valves of the classification stations to produce first and second controlled products of predetermined constituency, within given tolerances, the product control means including first and second maximum and first and second minimum timers for each station, the improvement comprising a method for initializing the maximum and minimum timers, comprising the steps of:

a) inputting and storing in the data storage means of a computing means operator-selected values of a set-up duration limit, a standard ratio of maximum-to-minimum timer settings and a base minimum timer setting;

b) setting all first minimum timers to zero and all first maximum timers to a predetermined preliminary maximum setting;

c) starting a set-up time counter that will determine how long the incoming feed will be monitored during operation of the tank;

d) counting and storing in a data storage means the total valve-open time for at least one valve at each station from the time the timer initialization routine begins until the time the set-up time counter reaches the set-up duration limit;

e) loading the valve-open time data into the computing means;

f) in the computing means, sorting the valve-open time data to identify the most active station, normalizing all other station valve-open times to the time of the most active station, multiplying the normalized valve-open times at each station by the base minimum timer setting to produce initialized minimum timer settings, multiplying the initialized minimum timer settings by the standard maximum-to-minimum timer ratio to produce initialized maximum timer settings;

g) re-setting the first maximum and minimum timers of each station to the initialized maximum and minimum timer settings for that station; and h) repeating steps (a)–(g) using the second maximum and minimum timers and second controlled product valves.

5. The method of claim 4 wherein the inputting and storing step is further characterized by presenting default choices for the operator-selected values to the operator.

6. The method of claim 4 wherein the step of counting and storing the valve-open times is characterized by storing the time that any valve at a station is open.

7. In a sand classifying tank or like apparatus for classifying granular material, of the kind including a series of classification stations at which different gradations of material accumulate at varying rates, each station having at least one controlled product valve for discharging material to at least one controlled product recombining means and an auxiliary valve for discharging to an uncontrolled residual product recombining means, the classifying tank further comprising a series of level sensors, one for each classification station, each level sensor actuating the valves at its classification station to discharge material whenever material has accumulated to a given level at that station, and product control means for continuously controlling the relative amounts of material discharged through the controlled product valves of the classification stations to produce controlled products of predetermined constituency, within given tolerances, the product control means including maximum and minimum discharge timers for each station, the improvement comprising an initialization system for the maximum and minimum timers, comprising:

data storage means for inputting and storing operator-selected values of set-up duration limit, a standard ratio of maximum-to-minimum timer settings and a base minimum timer setting;

a set-up duration time counter which is operable independently of any of the maximum and minimum timers and allows the tank to run for a set-up period equal to the set-up duration limit;

a valve-open time counter for each station, each counter being operable independently of the maximum and minimum timers for that station, to record the valve-open time for the controlled product valve during the set-up period;

computing means for sorting the valve-open time data to identify the most active station, normalizing all other station valve-open times to the time of the most active station, multiplying the normalized valve-open times at each station by the base minimum timer setting to produce initialized minimum timer settings, multiplying the initialized minimum timer settings by the standard ratio to produce initialized maximum timer settings; and means for re-setting the maximum and minimum timers of each station to the initialized maximum and minimum timer settings for that station.

8. In a sand classifying tank or like apparatus for classifying granular material, of the kind including a series of classification stations at which different gradations of material accumulate at varying rates, each station having at least one controlled product valve for discharging material to at least one controlled product recombining means, and an auxiliary valve for discharging to an uncontrolled residual product recombining means, the classifying tank further comprising a series of flow information sensors, for determining one of either sand accumulation rates within the tank or sand discharge rates from the tank, at least one sensor for each classification station, each flow information sensor actuating the valves at its classification station to discharge material whenever material has accumulated to a given level at that station, and product control means for continuously controlling the relative amounts of material discharged through the controlled product valves of the classification stations to produce controlled products of predetermined constituency, within given tolerances, the product control means including maximum and minimum discharge timers for each station, the improvement comprising an initialization system for the maximum and minimum timers, comprising:

data storage means for inputting and storing operator-selected values of variable parameters;

a set-up duration time counter which is operable independently of any of the maximum and minimum timers and allows the tank to run for a set-up period equal to the set-up duration limit, which may be pre-programmed or a variable parameter;

a means for observing and recording sand flow information at each station;

computing means for sorting the sand flow information collected at the classification stations to identify an arbitrarily-determined reference station, normalizing all other station flow data to that of the reference station, thereby establishing a relational framework, multiplying the normalized flow data from each station by one of a base minimum timer setting or a base maximum timer setting to produce initialized minimum or maximum timer settings, multiplying the resulting initialized timer settings by one of a standard maximum-to-minimum timer ratio or a standard minimum-to-maximum timer ratio, whichever is appropriate, to produce the other set of initialized timer settings; and means for re-setting the maximum and minimum timers of each station to the initialized maximum and minimum timer settings for that station.

9. In a sand classifying tank or like apparatus for classifying granular material, of the kind including a series of classification stations at which different gradations of material accumulate at varying rates, each station having at least one controlled product valve for discharging material to at least one controlled product recombining means and an auxiliary valve for discharging material to an uncontrolled residual product recombining means, the classifying tank further comprising a series of level sensors, at least one for each classification station, each level sensor actuating the valves at its classification station to discharge material whenever material has accumulated to a given level at that station, and product control means for continuously controlling the relative amounts of material discharged through the controlled product valves of the classification stations to produce controlled products of predetermined constituency, within given tolerances, the product control means including maximum and minimum timers for each station, the improvement comprising a method for initializing the maximum and minimum timers, comprising the steps of:

inputting and storing in a data storage means the operator-selected parameters that define the scope of the initialization routine and the degree of product control desired;

setting all minimum timers to zero and all maximum timers to a predetermined preliminary maximum setting;

starting a set-up time counter that will determine how long the sand flow will be monitored during operation of the tank;

counting and storing in a data storage means the total valve-open time for at least one valve at each station, from the time the timer initialization routine begins until the time the set-up time counter reaches the set-up duration limit;

loading the valve-open time data into a computing means;

in the computing means sorting the valve-open time data to identify an arbitrarily-chosen reference station, normalizing all other station valve-open times to the time of the reference station, thereby creating a relational framework, multiplying the normalized valve-open times at each station by one of a base minimum timer setting or a base maximum timer setting to produce initialized minimum or maximum timer settings, then multiplying the established initial minimum or maximum timer settings by one of either a standard maximum-to-minimum timer ratio or a standard minimum-to-maximum timer ratio, whichever is appropriate, to produce the rest of the initialized timer settings; and re-setting the maximum and minimum timers of each station to the initialized maximum and minimum timer settings for that station.

10. The method of claim 9, varying the calculation routine such that the determination of the initial maximum timer setting is made by adding an arbitrary value to the initial minimum timer setting, or, if the maximum timer setting is the first calculated, then the initial minimum timer setting may be determined by subtracting an arbitrary value from the initial maximum timer setting.

* * * * *